US011472046B2

(12) United States Patent
Bennik et al.

(10) Patent No.: US 11,472,046 B2
(45) Date of Patent: Oct. 18, 2022

(54) HAIR CUTTING APPLIANCE AND BLADE SET

(71) Applicant: KONINKLIJKE PHILIPS N.V., Eindhoven (NL)

(72) Inventors: Jan Bennik, Eindhoven (NL); Robbert Freerk Johan Van Der Scheer, Eindhoven (NL); Martinus Bernardus Stapelbroek, Eindhoven (NL); Albert Jan Aitink, Eindhoven (NL); Everhardus Johannes Hoexum, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 242 days.

(21) Appl. No.: 15/035,878

(22) PCT Filed: Nov. 21, 2014

(86) PCT No.: PCT/EP2014/075218
§ 371 (c)(1),
(2) Date: May 11, 2016

(87) PCT Pub. No.: WO2015/075159
PCT Pub. Date: May 28, 2015

(65) Prior Publication Data

US 2016/0271814 A1 Sep. 22, 2016

(30) Foreign Application Priority Data

Nov. 22, 2013 (EP) ..... 13193969

(51) Int. Cl.
*B26B 19/06* (2006.01)
*B26B 19/04* (2006.01)
*B26B 19/38* (2006.01)

(52) U.S. Cl.
CPC ..... *B26B 19/06* (2013.01); *B26B 19/046* (2013.01); *B26B 19/3846* (2013.01)

(58) Field of Classification Search
CPC ..... B26B 19/06; B26B 19/3846; B26B 19/38; B26B 19/04–08; B26B 19/0408
(Continued)

(56) References Cited

U.S. PATENT DOCUMENTS 2,102,529 A * 12/1937 Hanley ..... B26B 19/042 30/346.51
2,114,219 A * 4/1938 Florman ..... B26B 19/06 30/346.51
(Continued)

FOREIGN PATENT DOCUMENTS

CN 202985604 U 6/2013
DE 20213103187 U1 7/2013
(Continued)

OTHER PUBLICATIONS

JPH09253353A English Translation; Itou Kazuji; B26B19/10; Sep. 30, 1997.*
(Continued)

*Primary Examiner* — Laura M Lee

(57) ABSTRACT

The present invention relates to a hair cutting appliance (10) comprising a blade set (20), and to a blade set (20) of a hair cutting appliance (10). The blade set (20) is arranged to be moved through hair in an assumed moving direction (28) to cut hair. The blade set (20) comprises a stationary blade (22), a movable blade (24), and a lateral protecting element (56). The stationary blade (22) comprises at least one toothed cutting edge (32, 34), a lateral end (30), and a first surface (48) that is arranged, when in use for shaving purposes, as a skin-contacting surface. The movable blade (24) comprises a toothed cutting edge (32, 34). The stationary blade (22) and the movable blade (24) are arranged to be recip-
(Continued)

rocally moved with respect to each other in a cutting direction (Y) that is basically perpendicular to the assumed moving direction (28). The lateral protecting element (56) is associated with the lateral end (30), thereby defining a lateral end cap of the stationary blade (22), wherein the lateral protecting element (56) laterally shields a lateral edge (40) of the lateral end (30), such that, when in use, skin contact of the lateral edge (40) is prevented. The lateral protecting element (56) and the lateral end (30) cooperate so as to prevent hairs from being trapped there between. The stationary blade (22) and the movable blade (24) are at least partially made from steel, and the lateral protecting element (56) is made from plastic material. The blade set (20) configured to pivot or swivel with respect to a housing of the hair cutting appliance (10).

19 Claims, 5 Drawing Sheets

(58) Field of Classification Search
USPC ..... 30/43.92, 223, 225, 208, 346.51
See application file for complete search history.

(56) References Cited

U.S. PATENT DOCUMENTS

| | | | | | |
|---|---|---|---|---|---|
| 2,151,965 | A | * | 3/1939 | Hanley | B26B 19/042 30/346.51 |
| 2,203,021 | A | * | 6/1940 | Jones | B26B 19/042 30/43.92 |
| 2,205,905 | A | * | 6/1940 | Muros | B26B 19/06 30/346.51 |
| 2,233,446 | A | * | 3/1941 | Andis | B26B 19/042 30/43.2 |
| 2,242,405 | A | * | 5/1941 | Sussman | B26B 19/26 30/346.51 |
| 2,246,586 | A | * | 6/1941 | Hanley | B26B 19/38 30/34.2 |
| 2,253,037 | A | * | 8/1941 | Knapp | B26B 19/042 30/346.51 |
| 2,290,326 | A | | 7/1942 | Hanley | |
| 2,296,094 | A | * | 9/1942 | Dalkowitz | B26B 19/042 30/346.51 |
| 2,296,095 | A | * | 9/1942 | Dalkowitz | B26B 19/30 30/346.51 |
| 2,323,655 | A | * | 7/1943 | Hanley | B26B 19/38 30/346.51 |
| 3,279,056 | A | | 10/1966 | Mathew | |
| 3,373,747 | A | * | 3/1968 | Tapper | A61N 1/36034 607/72 |
| 3,477,127 | A | | 11/1969 | Regan | |
| 3,579,824 | A | * | 5/1971 | Matsumoto | B26B 19/042 30/346.51 |
| 3,967,372 | A | * | 7/1976 | Beck | B26B 19/102 30/34.1 |
| 4,442,596 | A | * | 4/1984 | Nasu | B26B 19/38 30/41 |
| 4,549,352 | A | * | 10/1985 | Ochiai | B26B 19/3853 30/41.5 |
| 4,619,048 | A | * | 10/1986 | Greutert | B26B 19/384 30/346.51 |
| 4,640,012 | A | * | 2/1987 | Thomas | B26B 21/40 30/32 |
| 4,884,338 | A | | 12/1989 | Stewart | |
| 4,899,444 | A | | 2/1990 | Trichell | |
| 5,504,997 | A | | 4/1996 | Lee | |
| 5,579,581 | A | | 12/1996 | Melton | |
| 6,499,218 | B2 | * | 12/2002 | Rocha | B26B 21/4043 30/526 |
| 7,346,990 | B2 | | 3/2008 | Dirks | |
| 7,415,768 | B2 | | 8/2008 | Bader | |
| 8,458,914 | B2 | | 6/2013 | Voorhorst | |
| 9,381,655 | B2 | | 7/2016 | Lau | |
| 9,381,656 | B2 | | 7/2016 | Van Straaten | |
| 10,478,981 | B2 | * | 11/2019 | Krauss | B26B 19/046 |
| 10,751,891 | B2 | * | 8/2020 | Feijen | B26B 19/3893 |
| 2003/0046817 | A1 | | 3/2003 | Coffin | |
| 2005/0120559 | A1 | | 6/2005 | Bressler | |
| 2006/0080837 | A1 | | 4/2006 | Johnson | |
| 2008/0034591 | A1 | * | 2/2008 | Fung | B26B 19/048 30/529 |
| 2009/0126201 | A1 | | 5/2009 | Melton | |
| 2010/0299930 | A1 | | 12/2010 | Voorhorst | |
| 2011/0225826 | A1 | | 9/2011 | Leventhal | |
| 2012/0110859 | A1 | | 5/2012 | Kammer | |
| 2012/0198698 | A1 | * | 8/2012 | Szczepanowski | B26B 21/4012 30/50 |
| 2013/0160296 | A1 | | 6/2013 | Park | |
| 2015/0251325 | A1 | * | 9/2015 | Teteak | B26B 19/386 30/228 |
| 2021/0260781 | A1 | * | 8/2021 | Koeppl | B26B 19/3846 |

FOREIGN PATENT DOCUMENTS

| | | | |
|---|---|---|---|
| EP | 0451402 | A1 | 10/1991 |
| EP | 2450161 | A1 | 5/2012 |
| GB | 2266259 | A | 10/1993 |
| JP | 09253353 | A | 9/1997 |
| WO | 2010065366 | A1 | 6/2010 |
| WO | 2011047221 | A1 | 4/2011 |
| WO | 2013150412 | A1 | 10/2013 |

OTHER PUBLICATIONS

Scali-Sheahan, Maura et al., "Milady's Standard Professional Barbering", USA, Cengage Learning, 2011, p. 11.
Kutz, Myer et al., "Handbook of Materials Selection", USA: John Wiley & Sons Inc., NY, 2002, pp. 335-226.
Douglas Bence: "Trouble With Stubble", Super Marketing Feb. 18, 1994.

* cited by examiner

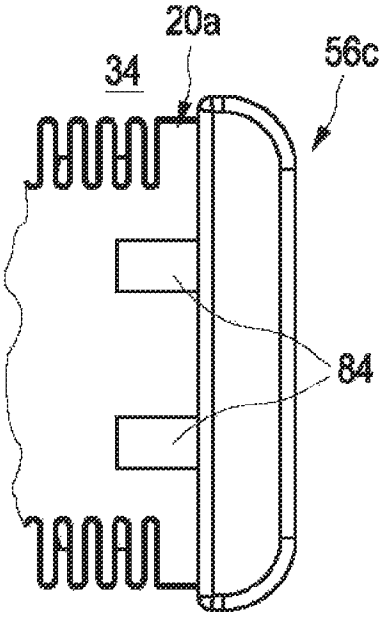
FIG. 9
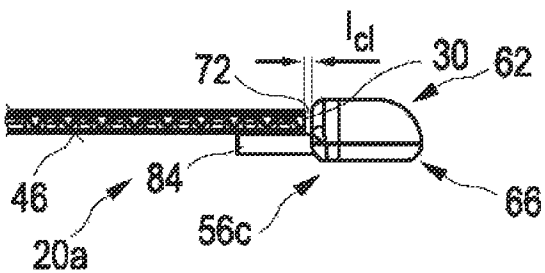
FIG. 10
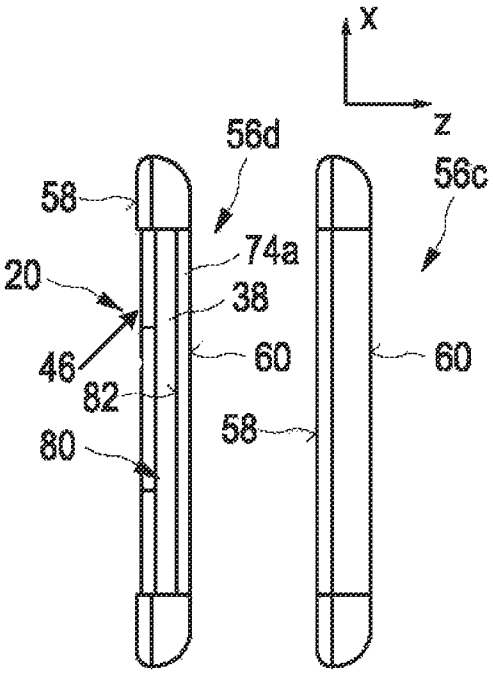
FIG. 11
FIG. 12
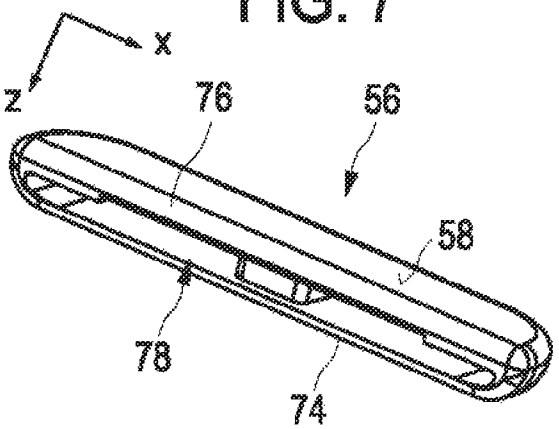
FIG. 7
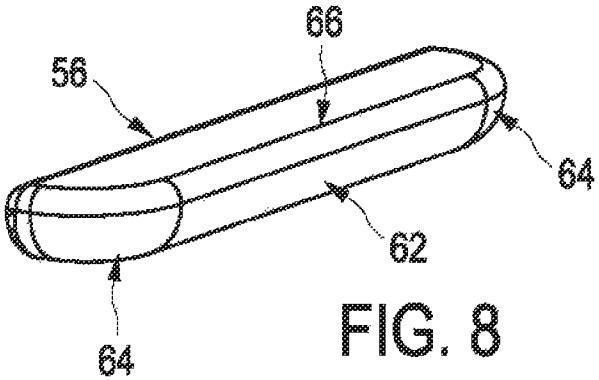
FIG. 8

HAIR CUTTING APPLIANCE AND BLADE SET

This application is the U.S. National Phase application under 35 U.S.C. § 371 of International Application No. PCT/EP2014/075218, filed on Nov. 21, 2014, which claims the benefit of International Application No. 13193969.6 filed on Nov. 22, 2013. These applications are hereby incorporated by reference herein.

FIELD OF THE INVENTION

The present invention relates to a hair cutting appliance, particularly to an electrically operated hair cutting appliance, and, more particularly, to a blade set for a cutting unit for such an appliance. The blade set may comprise a stationary blade comprising at least one toothed cutting edge and a movable blade comprising at least one toothed cutting edge, wherein the stationary blade and the movable blade are arranged to be moved with respect to each other to cut hair.

BACKGROUND OF THE INVENTION

U.S. Pat. No. 2,290,326 A discloses a shearing assembly comprising a handle casing, a blade holder removably affixed to the forward end of said casing, said holder comprising a generally rectangular end serving as a support for a flat shearing blade assembly the shearing edges of which protrude laterally beyond the longitudinal edges of said end, a pair of clamps slidable outwardly through corresponding transverse slots along the ends of said blade holder, wherein each of said clamps is a unitary piece and comprises an inturned lip to overlap the corresponding end of the shearing blade assembly, a shank which extends through a corresponding transverse slot near the corresponding end of the holder structure, and wherein the ends of said lip are joined to the widened upper end of the shank by corner pieces.

U.S. Pat. No. 2,151,965 A discloses a hair clipping head assembly comprising and inner shear plate and an outer shear plate, the outer shear plate comprising lateral flanges embracing the edges of the inner shear plate, wherein the inner plate comprises serrations and the outer plate comprises slots to form cooperating shear edges and cooperating shedding ports, wherein the outer plate comprises resilient mounting clips affixed to the ends thereof, and wherein the mounting clips comprise lateral downwardly extending resilient tongues for latching attachment of the assembly to a handle.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both, shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Unfortunately, common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small circular perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that often prevents hair from being cut off close to the skin. Consequently, a user desiring to both shave and trim his body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

WO 2013/150412 A1 tackles this issue by providing a blade set comprising a stationary blade that houses the movable blade such that a first portion of the stationary blade is arranged at the side of the movable blade facing the skin when in use, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge including respective teeth alternating with slots also allows for longer hairs to enter the slots and, consequently, to be cut by the relative cutting motion between the movable blade and the stationary blade.

SUMMARY OF THE INVENTION

The cutting appliance known from WO 2013/150412 A1 is particularly suited for both trimming and shaving operations. For trimming operations, the blade set is typically spaced or distanced from a skin surface level. For shaving operations, the blade set typically contacts and will be moved with respect to skin surface. However, aside from that, the document does not address particular shaving and trimming performance peculiarities and practical use aspects for these and further cutting operations. For instance, also styling operations may be envisaged where the user aims at precisely shaping an actual beard form, e.g. for shaping sideburns, a goatee, a mustache, etc. Such applications and, more generally, shaving and trimming suitability as such may raise several practical use and handling issues that need to be addressed.

It is an object of the present invention to provide for a hair cutting appliance, particularly for a blade set thereof, exhibiting improved daily-use suitability, particularly when used for shaving operations. It is, however, preferred not to mitigate a respective suitability for trimming operations. Particularly, a blade set for a hair cutting appliance may be presented that is arranged for both trimming and shaving operations and, advantageously, may reduce skin irritation when in use. It will be even further preferred to provide for a blade set that is relatively easy to manufacture and may nevertheless provide for an extended functionality. Even more preferably, the hair cutting appliance is also suited for precise styling operations. The invention is defined by the independent claims; the dependent claims define advantageous embodiments.

In a first aspect of the invention, a blade set for a cutting unit of a hair cutting appliance is presented, said blade set being arranged to be moved through hair in an assumed moving direction to cut hair, said blade set comprising a stationary blade comprising at least one toothed cutting edge, a first lateral end and a second lateral end, wherein the stationary blade further comprises a first surface that is arranged, when in use for shaving purposes, as a skin-contacting surface; a movable blade comprising at least one toothed cutting edge, wherein the stationary blade and the movable blade are arranged to be reciprocally moved with respect to each other in a cutting direction that is basically perpendicular to the assumed moving direction; and at least one lateral protecting element associated with at least one of the first lateral end and the second lateral end, thereby defining at least one lateral end cap of the stationary blade, wherein the stationary blade and the movable blade are at least partially made from steel, and the at least one lateral protecting element is made from plastic material. Herein, a plastic material covers any polymer material and/or any thermoplastic material, including natural rubber or synthetic rubber material, or thermoplastic elastomers.

The at least one lateral protecting element laterally shields at least one lateral edge of the respective lateral end, such that, when in use, skin contact of the at least one lateral end is prevented. Preferably, the at least one lateral protecting element and the respective lateral end cooperate so as to prevent hairs from being trapped therebetween.

This aspect is based on the insight that a blade set of a hair cutting appliance that is configured for both cutting and shaving operations needs to be relatively thin, at least at a skin-contacting portion of the stationary blade, to allow the removal of hairs as close as possible to the skin level. In this way, a clean or smooth shave may be enabled. However, at the same time, the relatively thin arrangement of the blade set may cause skin irritation when sliding on the skin surface when used for shaving. Since particularly the skin-contacting portion of the stationary blade may be actually so thin that relatively sharp edges may remain, even after chamfering or rounding at least some of the edges, the risk of skin irritations or even skin cuts may be the higher, the thinner the blade set and particularly the skin-contacting portion of the stationary blade thereof actually is. This applies in particular to the lateral ends of the blade set that, on the one hand, do not serve as cutting area but that may, on the other hand, scratch or cut the skin when being pushed against and moved with respect to the skin.

It is preferred that the blade set is arranged to be mounted to the housing of the hair cutting appliance in an exposed manner. In other words, the blade set, when coupled to the housing, may be considerably spaced from the housing of the appliance. For instance, it may be preferred that the lateral ends of the blade set are not embedded in or shielded by the housing of the hair cutting appliance. An exposed arrangement of the blade set of the cutting unit with respect to the housing of the hair cutting appliance is beneficial insofar as visibility of the blade set may be improved which is particularly beneficial for styling operations, and which may also facilitate trimming and shaving operations. Consequently, the operational maneuverability of the cutting unit with the blade set may be enhanced. However, also the lateral ends of the blade set are then spaced from the housing. The at least one side protecting element may therefore shield at least one lateral end of the blade which might protect the skin from directly contacting the at least one lateral end. Consequently, skin irritation occurrences or even skin cuts may be prevented.

The blade set is configured to pivot or swivel with respect to a housing of the hair cutting appliance. Also uneven or curved skin portions (e.g., chin portion or neck portion) may be shaved in this way, since the blade set may be arranged to "follow" the actual skin contour. In this respect, shaving performance may also benefit from the somewhat "exposed" arrangement of the blade set of the cutting unit with respect to the housing of the hair cutting appliance. Consequently, the blade set may not be sufficiently protected or covered at its lateral ends by the housing of the hair cutting appliance. It is, therefore, rather preferred to provide for the at least one protecting element that may be connected to the blade set, particularly to the stationary blade thereof, in a direct or indirect manner. The at least one lateral protecting element is configured and arranged such that at least the stationary blade and the at least one lateral protecting element undergo the same motion and orientation changes when in use. It is particularly preferred that the at least one lateral protecting element is fixedly connected to the stationary blade of the blade set.

The at least one lateral protecting element may cover the at least one lateral end of the stationary blade. Assuming that the stationary blade may have a considerably small thickness which may cause sharp edges or corners at the respective lateral ends, providing the at least lateral protecting element, may be beneficial insofar as the at least one lateral protecting element may be significantly "thicker" than the (skin-contacting portion of the) stationary blade. Consequently, enough space or material thickness is provided for chamfering or rounding the at least one protecting element. Consequently, the potentially sharp lateral ends of the stationary blade may be covered or shielded by additional caps that are sufficiently smoothed or rounded, so as to protect the skin when in contact.

As used herein, the assumed moving direction may also be referred to as intended moving direction, particularly provided for illustrative purposes herein. It may be further assumed that the intended moving direction is typically substantially parallel to a longitudinal direction (also referred to as X direction for the purpose of this disclosure) of the blade set that is basically perpendicular to a lateral direction or a cutting direction.

The at least one lateral protecting element may cooperate with the stationary blade so as to define a cooperative structure for using, during use, skin irritation or damage to the skin that might occur at uncovered lateral ends of blade sets. It is particularly preferred that the blade set comprises two protecting elements arranged at opposite lateral ends of the stationary blade. In some embodiments, the two protecting elements may be mirror-inverted.

In one embodiment, the at least one lateral protecting element comprises at least one smoothed edge transition, particularly a rounding, extending in a longitudinal direction X that is substantially perpendicular to the lateral direction Y, wherein the at least one smoothed edge transition is preferably convexly curved when viewed in a cross-sectional plane perpendicular to the longitudinal direction X. It might be further preferred that also at at least one of a longitudinal front end and a longitudinal back end of the at least one protecting element also a smoothed transition is provided.

The at least one smoothed edge transition may be configured for smooth-running or smooth-gliding with respect to the skin surface when in use for shaving. Furthermore, since the at least one protecting element may be regarded, at least in some embodiments, as an additional part, the at least one protecting element can be made of a material that is particularly skin-friendly and may further comprise a relatively low fraction coefficient.

In yet another embodiment, the at least one lateral protecting element may laterally overlap the at least one of the first lateral end and the second lateral end. Consequently, the at least one protecting element may be shaped as a lateral cover or hood that, on the one hand, at least partially covers the at least one lateral end of the stationary blade and that, on the other hand, may be connected to at least some of the portions of the stationary blade that are adjoining the lateral ends thereof. This may be beneficial, since in this way a contact area between the at least one protecting element and the stationary blade may be increased. It may be, however, preferred that the overlapping portion is as small as possible so as to avoid giving away an effective lateral extension of the cutting edge. As used herein, the term "laterally overlapping" may be regarded as an at least partial overlap of the stationary blade and the at least one protecting element in the lateral direction Y.

In still another embodiment, the at least one lateral protecting element laterally adjoins the at least one of the first lateral end and the second lateral end, wherein a lateral slot defining a maximum clearance between the at least one lateral protecting element and the at least one of the first lateral end and the second lateral end is adapted to an assumed cross-sectional extension of a hair filament. This embodiment is based on the insight that the at least one protecting element does not necessarily have to overlap (or enclose) the stationary blade also in the lateral direction Y. It is further preferred in this regard that, at least at the skin-facing side or portion of the stationary blade, the at least one protecting element does not protrude over a silhouette of the stationary blade in a vertical direction Z, i.e. towards the skin. This may be beneficial since in this way the protecting element does not add material to the skin-facing side of the stationary blade such that, when used for shaving purposes, skin hair can still be cut relatively close to the skin, preferably at the skin level.

It is further preferred that the at least one protecting element seamlessly adjoins the respective lateral end of the stationary blade. In other words, it is preferred that the at least one protecting element is arranged so close to the respective lateral end of the stationary blade that no hair filaments may enter the slot or gap between them. It is therefore particularly preferred that the slot between the at least one protecting element and the respective lateral ends has a lateral extension that is less than 0.15 mm, preferably less than 0.10 mm, more preferably less than 0.05 mm. Consequently, pinching and ripping-out of hair filaments in the slot or gap can be avoided.

According to still another embodiment, the at least one lateral protecting element comprises a lateral edge rounding, at a skin-oriented side thereof, that is greater than an overall stack height of the stationary blade, at least at the at least one cutting edge thereof. As indicated above, the at least one protecting element may comprise a vertical extension, basically perpendicular to an assumed level of the skin, that is greater than the thickness of the skin-contacting portion of the stationary blade and, more preferably, greater than the overall thickness or height of the stationary blade. The at least one protecting element can therefore be laterally rounded with a radius that may transition from a respective skin-facing side and a respective lateral side, that simply cannot be implemented with the stationary blade as such, due to the significantly smaller stack height. This applies in particular when further assuming that the lateral edge rounding tangentially merges into the skin-facing side and tangentially merges into the lateral side.

In yet another embodiment, the at least one lateral protecting element comprises an overall height extension that is greater than an overall height extension of the stationary blade, at least at the at least one cutting edge thereof, wherein at least one lateral protecting element is preferably arranged such that a bottom end surface of the at least one lateral protecting element facing away from the skin when in use, is offset in the height direction (or vertical direction) Z from a respective bottom end surface of the stationary blade, facing away from the skin when in use. In other words, the at least one lateral protecting element may "top" the stationary blade, due to the vertical offset. At the side facing away from the skin, material may be added without mitigating the shaving performance of the blade set. The more material is added in the height direction, the greater may be a respective lateral rounding of the at least one protecting element.

It is further preferred in this connection that the at least one lateral protecting element comprises a skin-facing end surface that is lined with or slightly elevated with respect to the first surface of the stationary blade in the height (or vertical) direction Z, wherein an offset dimension in the height direction Z is preferably in the range of about 0.5 mm to about 0.0 mm, preferably in the range of about 0.3 mm to about 0.0 mm. It is, in other words, preferred that the at least one protecting element does not vertically overlap towards the skin. Defining the axial to-be-selected offset dimension may be regarded as a trade-off between manufacturability and shaving performance. Preferably, the skin-facing surface of the stationary blade and the respective skin-facing surface of the lateral protecting element are basically leveled.

It is preferred in another embodiment that the at least one lateral protecting element overlaps the stationary blade in the longitudinal direction at the at least one cutting edge, wherein the at least one lateral protecting element preferably comprises at least one smoothed longitudinal end transition, preferably at least one frontal end rounding that is arranged to contact the skin, when in use for shaving purposes. According to this embodiment, the at least one lateral protecting element may be formed as a sliding skid that is adapted to smoothly run on the skin surface. The shape of the at least one protecting element may contribute to the alignment of the blade set with respect to the skin. Since the frontal end of the at least one protecting element may be located in front of the cutting edge of the blade set, when moved in the moving direction also a to-be-shaved region of the skin may be pre-aligned accordingly.

In still another embodiment, the at least one lateral protecting element comprises a recess portion, wherein the stationary blade defines a lateral opening at the at least one of the first lateral end and the second lateral end, wherein the lateral opening is associated with a guide slot for the movable blade provided at the stationary blade, wherein the recess portion and the lateral opening at least partially overlap each other, and wherein the at least one lateral protecting element comprises, at a skin-facing side thereof, a bar portion adjacent to the recess portion.

The lateral opening of the stationary blade may be regarded as an extension of a guide slot defined by the stationary blade for the movable blade. The lateral opening may therefore be used for removing dirt, cut hairs, etc., from the respective guide slot that otherwise might pollute or even block the blade set. It is therefore particularly preferred that the recess portion at the at least one protecting element unveils at least a portion of the lateral opening.

Consequently, particles and debris may be removed through the lateral end that is, at the same time, shielded by the at least one lateral protecting element. The recess portion in the at least one lateral protecting element may be defined as a lateral hole or opening, i.e. surrounded by respective walls of the at least one lateral protecting element. Alternatively, the recess portion may be formed as a recess or deepening in the at least one lateral protecting element that is preferably provided at the side thereof facing away from the skin when in use. In other words, it is preferred that at least one continuous bar portion is provided at the at least one lateral protecting element, the continuous bar portion substantially extending in the longitudinal direction X, wherein the continuous bar portion preferably shields at least a lateral end of the skin-contacting portion of the stationary blade.

It is preferred that the stationary blade and the movable blade are at least partially made from sheet metal material, wherein the at least one lateral protecting element is injection-molded from thermoplastic material. Thermoplastic material may be molded in a near-net shaped manner such that basically no further machining is required. Particularly, the at least one smoothed edge transition, more preferably the at least one edge rounding, can be shaped when injection-molding the at least one protecting element. The thermoplastic material can be selected such that low friction occurs when the blade set including the at least one protecting element, slides on the skin surface.

In an alternative embodiment, the stationary blade and the movable blade are at least partially made from steel, particularly from sheet metal material, wherein the at least one lateral protecting element is made from rubber or synthetic rubber material, particularly from thermoplastic elastomers. Thermoplastic elastomers can be processed and shaped via injection-molding methods.

It is further preferred that the at least one lateral protecting element is form-fitted to the stationary blade via at least one positive-locking feature such that the lateral protecting element cannot work loose from vibrations. Consequently, the at least one protecting element can be arranged as snap-on attachment part or, more preferably, as loss-proof attachment part.

Alternatively, or in addition, the at least one lateral protecting element may be force-fitted to the stationary blade, wherein the at least one lateral protecting element is preferably press-fitted or shrink-fitted to the stationary blade. Advantageously, form-fit features and force-features may be combined.

In yet another preferred embodiment, the at least one lateral protecting element is molded to the stationary blade, wherein the at least one lateral protecting element is preferably overmolded to or insert-molded with the stationary blade. Consequently, shaping and attaching the at least one protecting element to the stationary blade can be performed in a single manufacturing step. Overmolding or insert-molding may include providing the stationary blade in a mold for the at least one protecting element such that, upon molding the at least one protecting element, also at least one of a form-fit feature, a force-feature and a bonded contact for attaching the at least one protecting element to the stationary blade may be achieved.

It is further preferred that the at least one lateral protecting element is, more generally, bonded to the stationary blade. Bonding may include direct bonding, i.e. directly contacting the at least one lateral protecting element and the stationary blade, and mediately bonding, i.e. indirectly contacting the at least one protecting element and the stationary blade, e.g., when using adhesives, cement, etc. It may be further preferred that the stationary blade at least partially encloses the movable blade, wherein the stationary blade comprises a first substantially flat wall portion that is arranged, when in use, as a skin-facing wall portion, a second wall portion facing away from the skin, wherein the first wall portion and the second wall portion are connected at their at least one cutting edge, thereby defining a plurality of longitudinally extending stationary teeth alternating with respective tooth slots, wherein the movable blade is guided in a guide slot between a first wall portion and a second wall portion, such that teeth of the movable blade, arranged at the at least one cutting edge thereof, cooperate with the stationary teeth to cut hairs caught in the tooth slots.

In other words, more generally, the movable blade can be "sandwiched" between the first wall portion and the second wall portion of the stationary blade. This may provide the blade set, particularly the stationary blade thereof, with sufficient strength and thickness which may allow reducing the thickness of the first, skin-facing wall portion. Consequently, hairs can be cut even closer to the skin surface when shaving.

It is further preferred in this regard that the blade set comprises a first cutting edge and a second cutting edge longitudinally spaced from the first cutting edge, wherein the at least one lateral protecting element comprises a longitudinal extension that is adapted to an overall longitudinal extension of the stationary blade. It is further preferred that the at least one lateral protecting element comprises a longitudinal extension that is selected such that the at least one protecting element longitudinally overlaps or tops both the first cutting edge and the second cutting edge. Consequently, the at least one lateral protecting element may serve as a sliding skid into opposite moving directions.

By way of example, a thickness of the first wall portion, at least at the at least one cutting edge, may be in the range of about 0.04 mm to about 0.25 mm, preferably in the range of about 0.04 mm to 0.18 mm, more preferably in the range of about 0.04 mm to 0.14 mm. The thickness of the second wall portion, at least at the at least one leading edge, may be in the range of about 0.08 mm to 0.4 mm, preferably in the range of about 0.15 mm to 0.25 mm, more preferably in the range of about 0.18 mm to 0.22 mm. The thickness of the guiding slot defined by the first wall portion and the second wall portion of the stationary blade, that is basically adapted to the thickness of the movable blade, at least at the at least one leading edge, may be in the range of about 0.05 mm to about 0.5 mm, preferably in the range of about 0.05 mm to about 0.2 mm. An overall thickness or stack height, at least at the at least one leading edge, may be in the range of about 0.3 mm to about 0.75 mm, preferably in the range of about 0.4 mm to about 0.5 mm.

Another aspect of the present disclosure is directed to a hair cutting appliance comprising a housing accommodating a motor, and a cutting unit, wherein the cutting unit comprises an exposed blade set in accordance with the principles of the present disclosure. Preferably, the blade set comprises at least one lateral protecting element formed in accordance with at least some of the aspects and embodiments discussed herein. More preferably, the blade set is pivotably mounted at the housing, wherein the at least one lateral protecting element associated with the lateral end(s) is configured to move (pivot or swivel) along with the blade set. In other words, the at least one lateral protecting element may be basically independent from the housing of the hair cutting appliance. As a result, the hair cutting appliance may be particularly suited for shaving, trimming and styling operations, at least some of which may require a certain contour-following capability of the blade set.

These and other features and advantages of the disclosure will be more fully understood from the following description of certain embodiments of the disclosure, taken together with the accompanying drawings, which meant to illustrate and not to limit the disclosure.

BRIEF DESCRIPTION OF THE DRAWINGS

These and other aspects of the invention will be apparent from and elucidated with reference to the embodiment(s) described hereinafter. In the following drawings

FIG. 7 is a perspective bottom view of a lateral protecting element illustrating an inner lateral side thereof;

FIG. 8 is a further perspective bottom view of the lateral protecting element illustrating an outer lateral side thereof;

FIG. 9 is a partial bottom view of an alternative blade set fitted with an alternative side-protecting element;

FIG. 10 is a partial front view of the blade set shown in FIG. 9;

FIG. 11 is a lateral view of an embodiment of a lateral protecting element; and FIG. 12 is a further lateral view of another embodiment of a lateral protecting element fitted to a blade set.

DETAILED DESCRIPTION OF THE INVENTION

Figure 1:
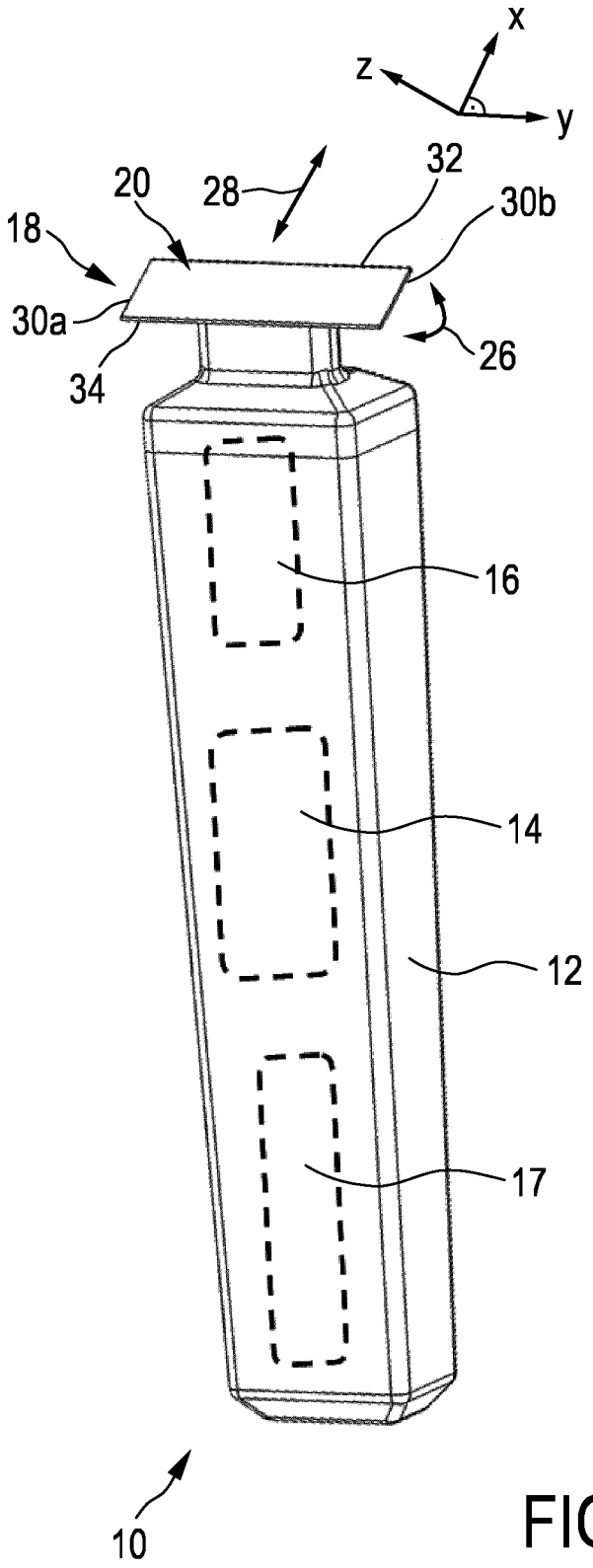
FIG. 1 shows a schematic perspective view of an exemplary electric hair cutting appliance fitted with an exemplary embodiment of a cutting unit that may be provided with a blade set in accordance with the principles of the present disclosure.

FIG. 1 schematically illustrates, in a simplified perspective view, an exemplary embodiment of a hair cutting appliance 10, particularly an electric hair cutting appliance 10. The cutting appliance 10 may include a housing 12, a motor indicated by a dashed block 14 in the housing 12, and a drive mechanism indicated by a dashed block 16 in the housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be provided with a power cable for connecting a power supply. A power supply connector may be provided in addition or in the alternative to the (internal) electric battery 17.

The cutting appliance 10 may further comprise a cutting head or cutting unit 18. At the cutting unit 18, a blade set 20 may be attached to the hair cutting appliance 10. The blade set 20 of the cutting unit 18 may be driven by the motor 14 via the drive mechanism 16 to enable a cutting motion.

Figure 2A:
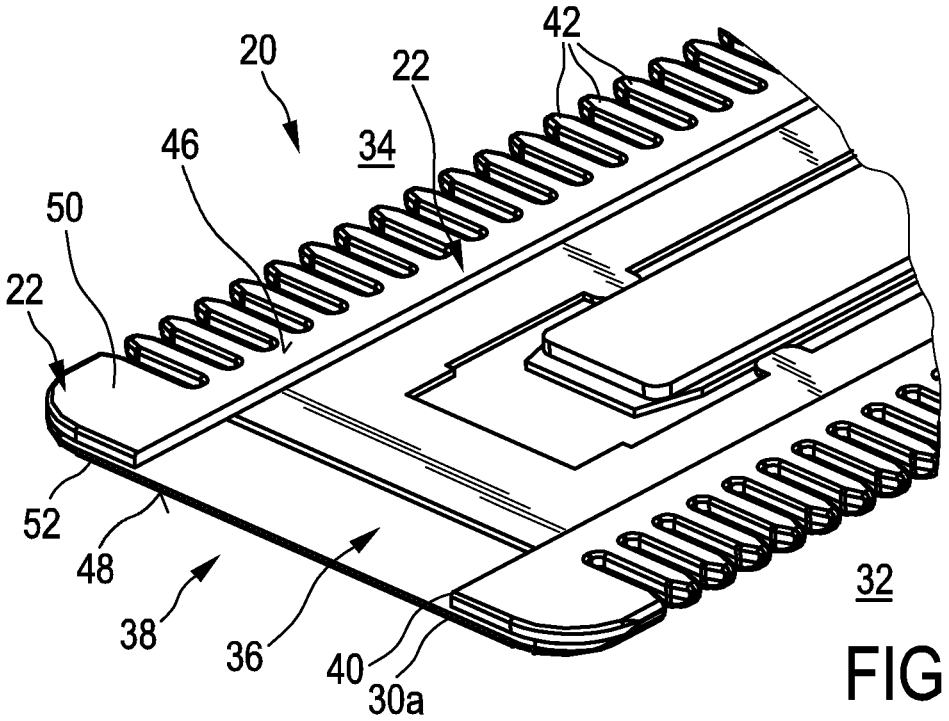
FIG. 2*a* is a partial perspective top view of a blade set of a cutting unit of a hair cutting appliance in accordance with FIG. 1.
Figure 2B:
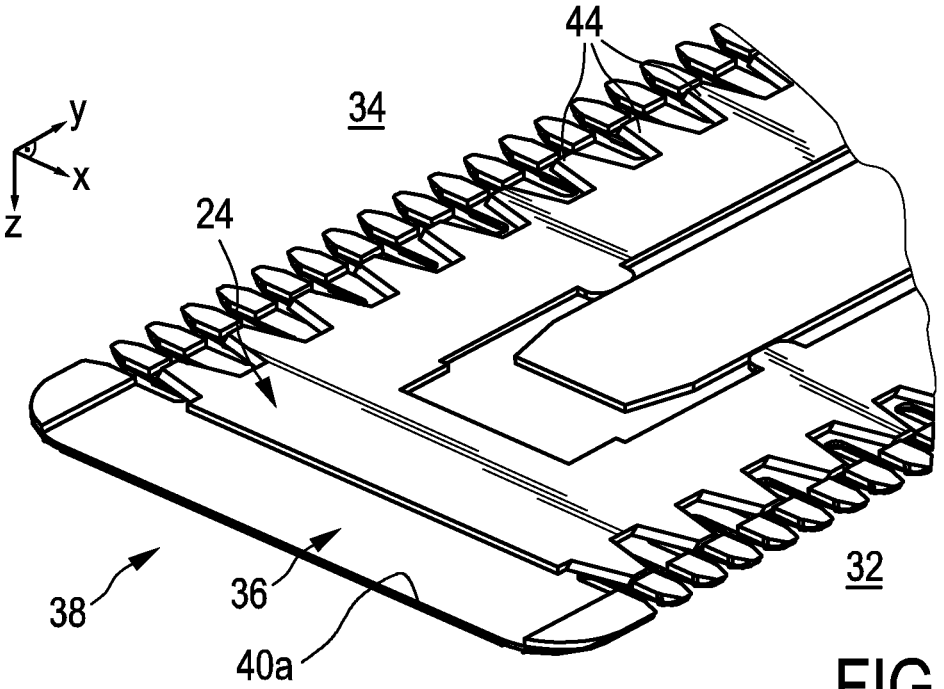
FIG. 2*b* is a further partial perspective bottom view corresponding to the view of FIG. 2*a*, a wall portion of the blade set omitted primarily for illustrative purposes.

The cutting motion may be generally regarded as relative motion between a stationary blade 22 and a movable blade 24 of the blade set 20, see also FIGS. 2*a* and 2*b*. Generally, a user may grasp and guide the cutting appliance 10 through hair in a moving direction 28 to cut hair. Furthermore, the blade set 20 can be arranged at the cutting unit 18 in a pivoting manner, refer to the curved double-arrow indicated by reference numeral 26. In some embodiments, the cutting appliance 10, or, more specifically, the cutting unit 18 including the blade set 20, can be passed along skin to cut hair growing at the skin. When cutting hair closely to the skin, basically a shaving operation can be performed aiming at cutting (or chopping) at the level of the skin. However, also clipping (or trimming) operations may be envisaged, wherein the cutting unit 18 comprising a blade set blade set 20 is passed along a path at a desired distance relative to the skin.

When being guided or led through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference and having a fixed definition and relation with respect to the orientation of the cutting appliance 10 and its cutting unit 18 fitted with the blade set 20. That is, an overall orientation of the cutting appliance 10 with respect to the to-be-cut hair at the skin may be construed as somewhat unsteady. However, for illustrative purposes, it can be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several of FIGS. 1 to 12. By way of example, a Cartesian coordinate system X-Y-Z is indicated in FIG. 1. An X axis of the respective coordinate system extends in a generally longitudinal direction that is generally associated with length, for the purpose of this disclosure. A Y axis of the coordinate system extends in a lateral (or transverse) direction associated with width, for the purpose of this disclosure. A Z axis of the coordinate system extends in a height (or vertical) direction which may be referred to for illustrative purposes, at least in some embodiments, as a generally vertical direction. It goes without saying that an association of the coordinate system to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective FIGS. and illustrations including different orientations.

The blade set 20 may further comprise a first lateral end 30*a* and a second lateral end 30*b* at the stationary blade 22. The lateral ends 30*a*, 30*b* are spaced from each other in the lateral direction Y. The stationary blade 22 defines a guiding slot 36 for the movable blade (cf. FIG. 2*b*). Furthermore, at at least one of the lateral ends 30*a*, 30*b* of the blade set 20, a lateral opening 38 may be provided. In some embodiments, the lateral opening 38 may be regarded as an extension of the guiding slots 36 in the stationary blade 22.

As can be best seen in FIG. 1, the blade set 20 may be regarded, at least in some embodiments, as a somewhat exposed blade set 20. In other words, the blade set 20 may be spaced from a main body of the housing 12 of the hair cutting appliance 10. This may increase the visibility of the blade set 20 during operation and improve the maneuverability of the cutting unit 18. Since the hair cutting appliance 10 is preferably suited for shaving, trimming and styling operations, it is preferred that the blade set 20 is pivotably mounted at the housing 12 (cf. reference numeral 26 in FIG. 1). Consequently, since the blade set 20 is then movable (swiveling or pivoting motion) with respect to the housing 12, the lateral ends 30*a*, 30*b* basically cannot be protected or shielded by fixed housing components. It is therefore preferred that lateral shielding or capping is performed by components of the cutting unit 18 that may basically move (pivot or swivel) along with the blade set 20.

FIGS. 2*a* and 2*b* illustrate a partial detailed view of the blade set 20 of the cutting unit 18 exemplarily shown in FIG. 1. The blade set 20 comprises a stationary blade 22 and a movable blade 24. The blade set 20, or, more specifically, the stationary blade 22 and the movable blade 24 thereof, may comprise a first toothed cutting edge 32 and a second toothed cutting edge 34. The cutting edges 32, 34 are clearly visible and may be guided with significant accuracy, e.g. when cutting (e.g. shaving or trimming), more particularly when styling facial hair in front of a mirror. The cutting edges 32, 34 are spaced from each other in the moving direction 28 that is basically parallel to the longitudinal direction X. The stationary blade 22 and the movable blade 24 may comprise a basically flat shape. It is particularly preferred that the stationary blade 22 is arranged to house and to guide the movable blade 24. In other words, the stationary blade 22 may be regarded as a shell or a cage for the movable blade 24. The stationary blade 22 may comprise a cross-section, viewed in the plane perpendicular to the lateral direction Y, that is, at the at least one cutting edge 32, 34, basically U-shaped. The U-shaped form may comprise a first leg and a second leg. Between the first leg and the second leg a guiding slot for the movable blade 24 may be defined. The movable blade 24 can be housed and guided in the stationary blade 22 for lateral movement with respect to the stationary blade 22. The stationary blade 22 basically encloses the movable blade 24 at the side thereof facing the skin when cutting hair and, at least partially, at the side thereof facing away from the skin when cutting hair. The stationary blade 22 may comprise a plurality of teeth 42. The movable blade 24 may comprise a plurality of teeth 44. The teeth 42 of the stationary blade and the teeth 44 of the movable blade are respectively arranged at the cutting edges 32, 34 to cooperate in a cutting action for cutting hair.

The stationary blade 22, or, more generally, the blade set 20, comprises a bottom end surface 46 that may also be regarded as a surface or side facing away from the skin, when in use. Opposite to the surface 46, a top end surface 48 is provided, that may also be regarded as a surface or side facing the skin or contacting the skin when in use. As used herein, the surface 48 may also be regarded as a first surface of the stationary blade. As used herein, the surface 46 may also be regarded as a second surface of the stationary blade.

This stationary blade may further comprise a first portion or wall portion 52 and a second portion or wall portion 50. The first wall portion 52 comprises a first surface 48. The second wall portion 50 comprises a second surface 46. The first wall portion 52 may also be regarded as skin-facing or skin-contacting wall portion. The second wall portion 50 may also be regarded as the wall portion facing away from the skin, when in use. The second wall portion 50 and the second surface 46 basically face the housing 12 of the hair cutting appliance 10.

So as to suitably adapt the blade set 20 to shaving operations, it is preferred that a general height (or thickness) of the blade set 20, at least at the at least one cutting edge, is relatively small. Particularly, it is preferred that a skin-sided portion of the stationary blade 22 has a thickness that is relatively small. Even more preferably, the thickness of the stationary blade portion facing the skin is significantly smaller than the thickness of the stationary blade portion facing away from the skin, at least at the cutting edge. An exemplary blade set 20 for the hair cutting appliance 10 may comprise an overall height or thickness in the range of about 0.3 mm to about 0.75 mm. The height or thickness of the skin-facing portion of the stationary blade 22, at least at the at least one cutting edge, may be in the range of about 0.04 mm to about 0.25 mm. The height or thickness of the stationary blade portion facing away from the skin may be in the range of about 0.08 mm to about 0.4 mm. The height thickness of the movable blade 24, at least at the least one cutting edge, may be in the range of about 0.05 mm to about 0.5 mm. The height of the movable blade 24 may basically correspond to a height of the guiding slot defined by the stationary blade 22 for the movable blade 24.

At the at least one lateral end 30*a*, 30*b* of the stationary blade 22, at least one lateral edge 40, 40*a* may be provided. As used herein, the at least one lateral edge 40 may be regarded as a basically sharp edge or corner that may cause skin irritation and/or even skin cuts when sliding at the skin during use. Since the stationary blade 22 is preferably particularly thin, when compared with conventional trimmer blades, and since the stationary blade may be basically composed of a first wall portion 52 and a second wall portion 50 that may be connected at the at least one leading edge, not enough thickness or, more generally, material in the vertical direction Z may be provided for sufficiently smoothing (i.e. chamfering and/or rounding) the at least one lateral end 30*a*, 30*b*. Furthermore, since at least one lateral opening 38 may be provided that may correspond to a lateral silhouette of the guiding slot 36, even more potentially sharp edges and corners may be provided at the at least one lateral end 30*a*, 30*b*.

Figure 3:
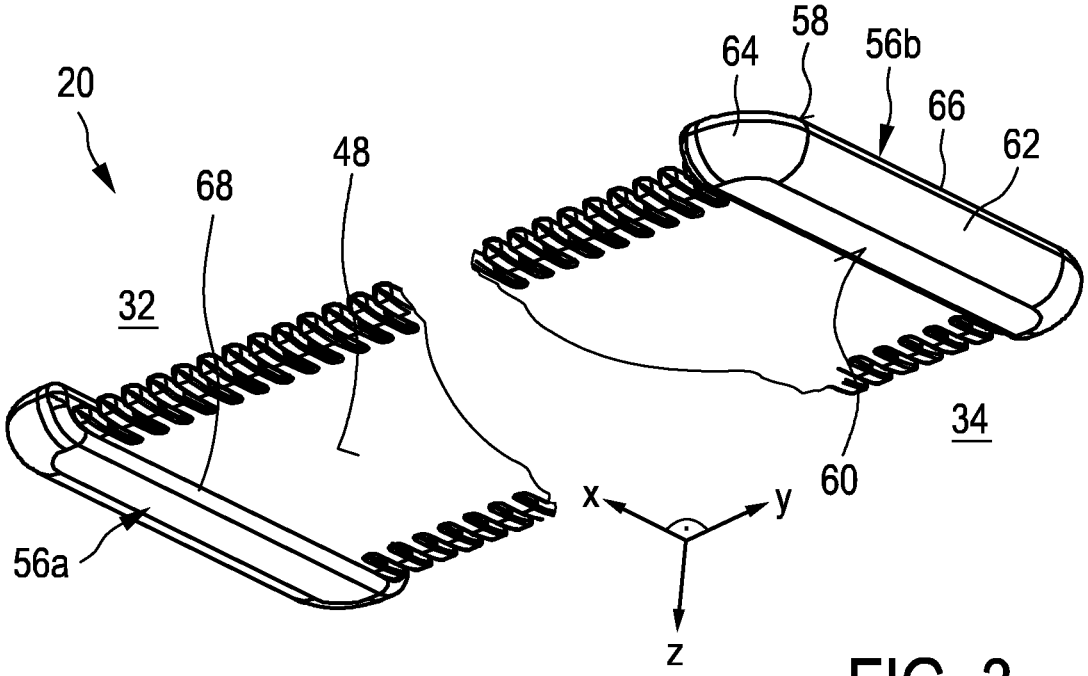
FIG. 3 is a broken perspective top view (or skin-side view) of a blade set fitted with a first lateral protecting element and a second lateral protecting element.
Figure 4:
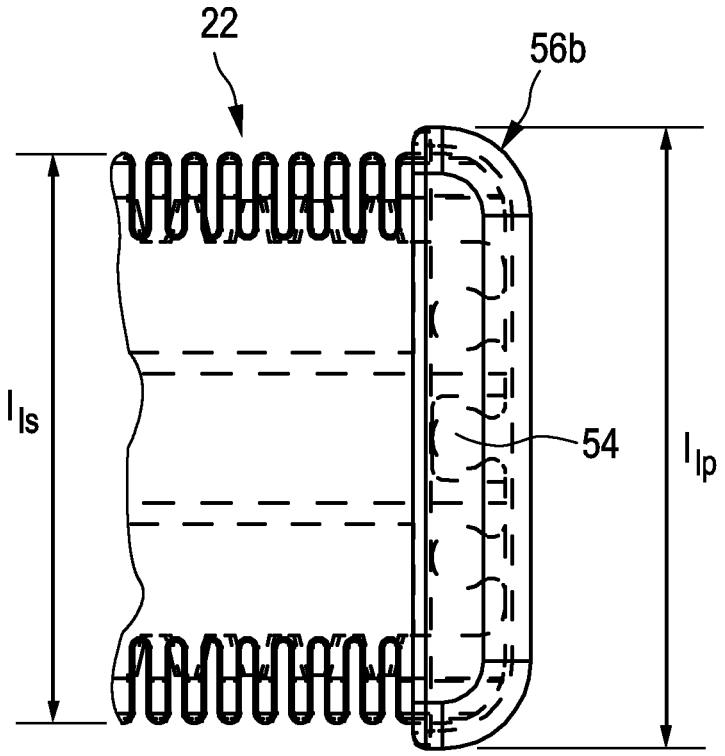
FIG. 4 is a partial top view of the blade set shown in FIG. 3, wherein hidden edges are indicated by dashed lines.
Figure 5:
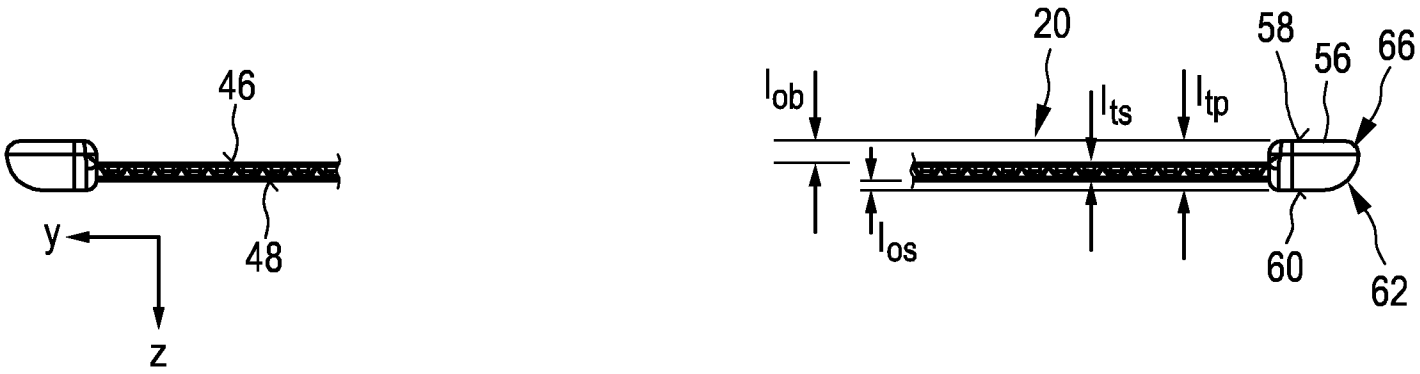
FIG. 5 is a broken front view of the blade set shown in FIG. 3.

With particular reference to FIGS. 3 to 5, a preferred arrangement of the blade set 20 is illustrated and further detailed, the blade set 20 being fitted with at least one protecting element 56*a*, 56*b*. Preferably, each of the lateral ends 30*a*, 30*b* (cf. FIG. 1) is covered or shielded by a respective lateral protecting element 56*a*, 56*b*. Potentially sharp lateral edges and corners 40, 40*a* (cf. FIGS. 2*a*, 2*b*) can be covered by the at least one lateral protecting element 56*a*, 56*b*. Consequently, apart from the at least one cutting edge 32, 34, no harmful, potentially skin-irritating features can touch the skin, when the appliance 10 is in use.

The at least one lateral protecting element 56*a*, 56*b* may be configured for smoothening at least one edge contour of the stationary blade 22 of the blade set 20. To this end, the at least one lateral protecting element may comprise a rounded or smoothened edge transition 62 that is basically extending in the longitudinal direction X. In other words, the rounded edge transition 62 may extend substantially parallel to the at least one lateral end 30 of the blade set 20. The at least one lateral protecting element 56*a*, 56*b* may comprise a bottom end surface 58 that may also be referred to as a surface facing away from the skin when in use. The at least one lateral protecting element 56*a*, 56*b* may further comprise a top end surface 60 that may also be referred to as skin-facing surface. The first surface 48 of the stationary blade 22 and the top end surface 60 may face the skin when in use. The rounding radius of the rounded edge transition 62 may be significantly greater than a rounding radius that could be provided at any of the lateral edges 40, 40*a* of the at least one lateral end 30*a*, 30*b* of the stationary blade 22 as such.

The at least one lateral protecting element 56*a*, 56*b* may further comprise a bottom transition 66, that may be rounded or chamfered as well. A lateral transition between the bottom end surface 58 and the top end surface 60 may be defined by the edge transition 62 and the bottom transition 66. Particularly, the bottom transition 66 and the edge transition 62*a* are tangentially connected to the bottom end surface 58 and the top end surface 60, respectively.

As can be best seen in FIG. 4, the at least one lateral protecting element 56*a*, 56*b* may comprises a longitudinal extension $l_{lp}$ that is greater than a respective longitudinal dimension $l_{ls}$ of the stationary blade 22. It is particularly preferred that the lateral protecting element 56*a*, 56*b* longitudinally overlaps the stationary blade 22, particularly the cutting edges 32, 34 thereof. Consequently, a furthermost point of the at least one lateral protecting element 56*a*, 56*b* may be (positively) offset from a respective furthermost point of (a tooth tip of) the stationary blade 22. Consequently, the lateral protecting element 56*a*, 56*b* may serve as a sliding skid.

Preferably, the lateral protecting element 56*a*, 56*b* further comprises at least one (frontal) end radius 64. Preferably, each of the at least one cutting unit 32, 34 is associated with a respective (frontal) end radius 64 of the lateral protecting element 56*a*, 56*b*. Furthermore, an inner transition or inner rounding 68 may be present at the lateral protecting element 56*a*, 56*b*.

With further reference to FIG. 4, a hidden-edge representation of at least one positive-locking feature 54 is provided. The at least one positive-locking feature 54 may be provided at the lateral protecting element 56*a*, 56*b*. The at least one positive-locking feature 54 may fix and secure the lateral protecting element 56*a*, 56*b* at the stationary blade 22 of the blade set 20.

Figure 6:
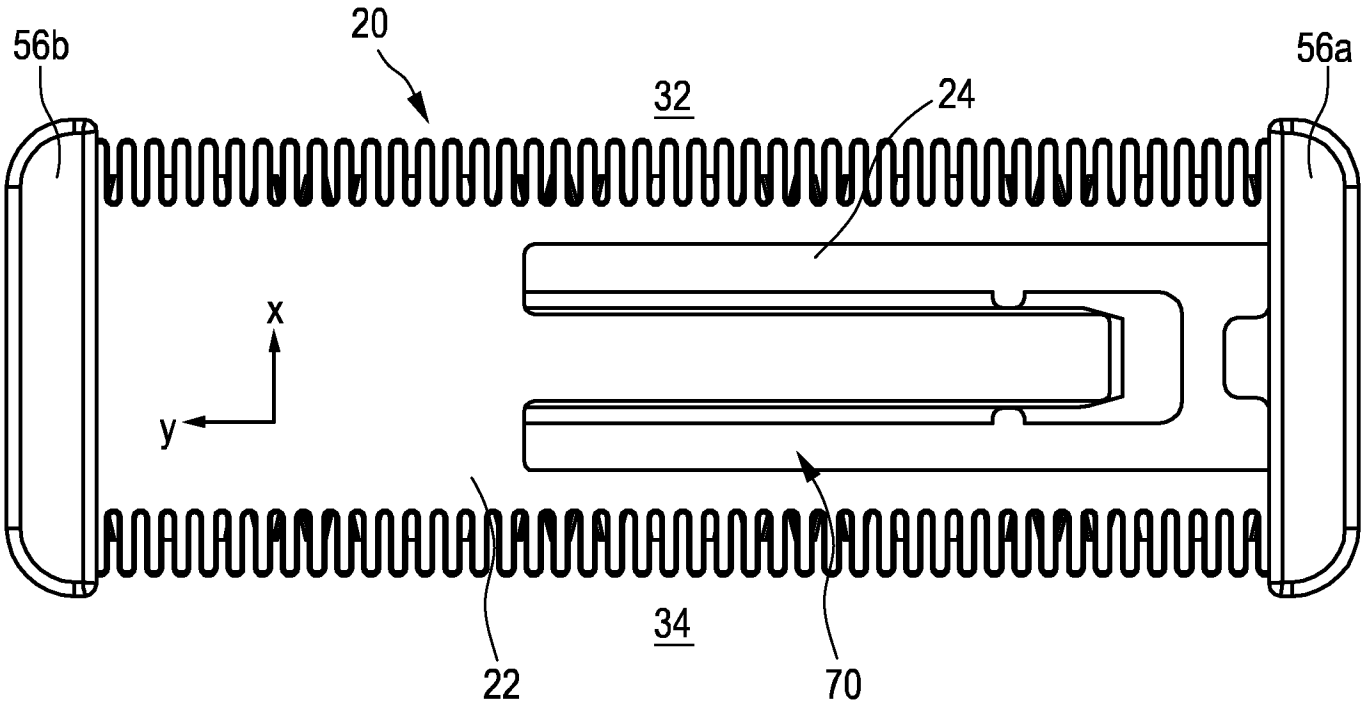
FIG. 6 is a bottom view of the blade set shown in FIG. 3.

Further reference is made to FIGS. 5 and 6 illustrating respective frontal and bottom views of the blade set 20 fitted with the at least one lateral protecting element 56*a*, 56*b*. As can be best seen from the broken view of FIG. 5, the blade set 20 or, more particularly, the stationary blade 22 thereof, may comprise an overall extension $I_{ts}$ in the vertical (or height) dimension Z. Accordingly, the at least one lateral protecting element 56*a*, 56*b* may comprise an overall thickness extension $I_{tp}$. Generally, the overall thickness of the lateral protecting element 56*a*, 56*b* may be greater than the overall thickness of the stationary blade 22 $I_{ts}$. It is particularly preferred that the at least one lateral protecting element 56*a*, 56*b* tops the stationary blade 22 at the bottom side thereof. In other words, the bottom end surface 58 of the lateral protecting element 56*a*, 56*b* and the second surface 46 of the stationary blade 22 may be offset by a (vertical) bottom offset dimension $l_{ob}$. Furthermore, the top end surface 60 of the lateral protecting element 56*a*, 56*b* and the first surface 48 may be offset by a skin-orientated offset dimension $I_{os}$. It is particularly preferred that, if any, the offset of the lateral protecting element 56*a*, 56*b* with respect to the stationary blade 22 in the height direction Z is primarily provided at the side that is facing away from the skin when in use. It may be further preferred in some embodiments that the first surface 48 of the stationary blade 22 and the top end surface 60 of the at least one lateral protecting element 56*a*, 56*b* are at least substantially aligned, i.e. the dimension lis close or equal to zero. It is further preferred that a radius of the smoothened edge transition 62 is greater than the overall thickness $I_{ts}$ of the stationary blade 22.

With further reference to FIG. 6, a drive engagement slot 70 is illustrated through which the movable blade 24 can be engaged and operated, so as to generate the relative motion between the stationary blade 22 and the movable blade 24. The drive mechanism 16 (cf. FIG. 1) may contact the movable blade 24 via the drive engagement slot 70.

With particular reference to FIGS. 7 and 8, and with further reference to FIG. 4, an exemplary embodiment of the lateral protecting element is elucidated. The lateral protecting element 56 may be formed in a cap-like manner including at least one mating slot or mating recess 78 at an (inner) lateral side thereof. The at least one mating slot 78 is preferably adapted to the at least one lateral end 30*a*, 30*b* in the stationary blade 22 (cf. FIGS. 2*a* and 2*b*), such that the lateral protecting element 56 can be mounted thereto. In some embodiments, the lateral protecting element 56 may be form-fitted to the stationary blade 22. In some alternative embodiments, the at least one lateral protecting element 56 may be force-fitted to the stationary blade 22. Furthermore, in some embodiments, the at least one lateral protecting element 56 may be bonded to the stationary blade 22. Bonding may involve overmolding, insert-molding, etc.

As can be best seen in FIG. 7, respective longitudinal ends of the lateral protecting element 56 can be connected (i.e., to each other) via a first wall 74 and a second wall 76 thereof. At the first wall 74, a top end surface (i.e., top end surface 60 as shown in FIGS. 11 and 12) may be provided. At the second wall 76, the bottom end surface 58 may be provided.

With further reference to FIGS. 9 and 10, an alternative embodiment of a blade set 20*a* fitted with at least one lateral protecting element 56*c* is illustrated and further detailed. As can be best seen from FIG. 4, the lateral protecting element 56*c* is laterally adjoining the respective lateral end 30 of the stationary blade 22. While the lateral protecting element 56 illustrated in FIGS. 7 and 8 is configured for overlapping the at least one lateral end 30 in the lateral direction Y, the lateral protecting element 56*c* shown in FIGS. 9 and 10 is, on the other hand, adapted to abut the respective lateral end 30. In other words, the lateral protecting element 56 of FIGS. 7 and 8 may be shaped in a cap-like manner. The lateral protecting element 56*c* of FIGS. 9 and 10 is rather defined as a neighboring part. In some embodiments, a relatively small lateral clearance $l_{cl}$ may be provided between the lateral end 30 of the stationary blade 22 and the lateral protecting element 56. It is particularly preferred that, if any, the lateral clearance $l_{cl}$ is adapted to an assumed cross-sectional dimension (e.g., diameter) of a hair filament, such that preferably no hair may enter the respective lateral slot 72 between the lateral end 30 and the lateral protecting element 56. The lateral protecting element 56 may be attached to the stationary blade 22, particularly to the second surface 46 thereof, via at least one connecting tap 84 which may be regarded as at least one lateral extension at the inner side of the lateral protecting element 56*c*.

With further reference to FIGS. 11 and 12, further embodiments of lateral protecting elements 56*c*, 56*d* will be elucidated. As can be best seen from FIG. 11, showing a lateral view of the lateral protecting element 56*c*, the lateral protecting element 56 comprises a shape and extension that exceeds the extension of the at least one lateral end 30 of the stationary blade 22 in the height direction Z and in the longitudinal direction X. Consequently, also a lateral opening 38 in the stationary blade 22 (cf. FIGS. 2*a* and 2*b*) can be shielded or covered. However, in some embodiments, it is preferred that the at least one lateral opening 38 is not covered (laterally) by the lateral protecting element 56. In this connection, reference is made to FIG. 12. The lateral protecting element 56*d* illustrated therein comprises a recess portion 80 that may be shaped as a deepening or a hole portion (i.e., indicated by reference numeral 146 in FIG. 12). For instance, the recess portion 80 may comprise a recess surface 82 that is offset from the bottom end surface 58 of the lateral protecting element 56*d* in the height dimension Z. Respective ends of the lateral protecting element 56*d* in the longitudinal direction X are therefore primarily connected by a single wall or first wall 74*a* (i.e., also referred to herein as a bar portion adjacent to the recess portion 80 at the recess surface 82, when viewing the lateral silhouette of the lateral protecting element 56*d* as shown in FIG. 12). The first wall 74*a* basically extends in the longitudinal direction (i.e., the X direction between respective longitudinal ends of the lateral protecting element) and is particularly arranged to cover or shield at least the first wall portion 52 of the stationary blade 22 (cf. FIGS. 2*a* and 2*b* in this connection). Consequently, at least a portion of the lateral opening 38 in the stationary blade 22 is accessible (i.e., not covered in the (-Z) direction, such that hairs and beard can be removed therefrom.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the stationary blade, the blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A blade set of a hair cutting appliance, said blade set being arranged to be moved through hair in a moving direction to cut hair, said blade set comprising:

a stationary blade comprising at least one toothed cutting edge, and a lateral end, wherein the stationary blade further comprises a first surface and a second surface that are arranged, when in use for shaving purposes, as a skin-contacting surface and a surface facing in a direction opposite from the skin-contacting surface, respectively, the stationary blade further comprising a guide slot located between the first and second surfaces, a movable blade comprising a toothed cutting edge, wherein the movable blade is arranged within, and having both top and bottom surfaces of the toothed cutting edge thereof enclosed by, the guide slot of the stationary blade to be reciprocally moved with respect to the stationary blade in a cutting or lateral direction (Y) that is perpendicular to the moving direction, and a lateral protecting element fixedly connected to the stationary blade at the lateral end of the stationary blade, wherein the lateral protecting element comprises a lateral end cap having a top end surface and a bottom end surface that are arranged, when in use for shaving purposes, as a skin-facing surface and a surface facing in a direction opposite from the skin-facing surface, respectively, wherein the lateral protecting element laterally shields a lateral edge of the lateral end, such that, when in use, skin contact of the lateral edge is prevented, and wherein the lateral protecting element and the lateral end cooperate so as to prevent hairs from being trapped there between, wherein the lateral protecting element further comprises a recessed portion, wherein the recessed portion includes an aperture provided at a same side of the lateral protecting element as the bottom end surface, and wherein the lateral protecting element further comprises, at the top end surface of the lateral protecting element, a bar portion adjacent to the recessed portion, and wherein the stationary blade further includes a lateral opening at the lateral end, wherein the lateral opening comprises an extension of the guide slot in the stationary blade for the movable blade, wherein (i) the recessed portion of the lateral protecting element and (ii) the lateral opening, which includes the extension of the guide slot at the lateral end of the stationary blade, at least partially overlap each other, and wherein the recessed portion exposes the lateral opening and the extension of the guide slot at the lateral end of the stationary blade on the same side as the bottom end surface of the lateral protecting element to enable a removal of hair cutting particles and debris from an exposed portion of the extension of the guide slot at the lateral end of the stationary blade, via the aperture of the lateral protecting element, in the lateral direction and in a direction away from the bar portion towards the bottom end surface, opposite the top end surface, wherein the stationary blade at least partially encloses the movable blade, wherein each of the least one cutting edge of the stationary blade comprises (i) a first substantially flat wall portion having a plurality of bottom teeth at a bottom cutting edge and that is arranged, when in use, as a skin-facing wall portion, and (ii) a second wall portion having a plurality of top teeth at a top cutting edge and that is arranged, when in use, as a wall portion facing away from the skin, wherein the first wall portion and the second wall portion are connected at distal end portions of corresponding teeth of the plurality of bottom teeth and the plurality of top teeth and defines a portion of the guide slot within the corresponding toothed cutting edge, thereby defining a plurality of longitudinally extending stationary teeth alternating with respective tooth slots, wherein the movable blade is guided within the guide slot and sandwiched between the first wall portion and the second wall portion such that teeth of the movable blade arranged at the toothed cutting edge thereof, cooperate with the stationary teeth to cut hairs caught in the tooth slots, and wherein the stationary blade and the movable blade comprise at least steel, and the lateral protecting element comprises a plastic material.

2. The blade set as claimed in claim 1, wherein the lateral protecting element comprises a smoothed edge transition that includes a rounding, extending in a longitudinal direction (X) that is substantially perpendicular to the lateral direction (Y), wherein further the smoothed edge transition is convexly curved when viewed in a cross-sectional plane perpendicular to the longitudinal direction (X).

3. The blade set as claimed in claim 1, wherein the lateral protecting element laterally overlaps the lateral end.

4. The blade set as claimed in claim 1, wherein the lateral protecting element laterally adjoins the lateral end, wherein a lateral slot between the lateral protecting element and the lateral end has a maximum clearance dimension no greater than a cross-sectional extension of a hair filament such that hair may not enter the lateral slot between the lateral protecting element and the lateral end.

5. The blade set as claimed in claim 1, wherein the lateral protecting element comprises a lateral edge rounding, at a skin-oriented side thereof, that is greater than an overall height of the stationary blade, at least at the cutting edge thereof.

6. The blade set as claimed in claim 1, wherein the lateral protecting element comprises an overall height extension that is greater than an overall height extension of the stationary blade, at least at the cutting edge thereof, wherein the lateral protecting element is arranged such that the bottom end surface of the lateral protecting element, facing away from the skin when in use, is offset in the vertical direction (Z) from a respective bottom end surface corresponding with the second surface of the stationary blade, facing away from the skin when in use.

7. The blade set as claimed in claim 1, wherein the top end surface is aligned with or slightly elevated with respect to the first surface of the stationary blade in the vertical direction (Z), wherein an offset dimension in the vertical direction (Z) comprises a dimension selected from the group consisting of (i) a range of 0.5 mm to 0.0 mm, and (ii) a range of 0.3 mm to 0.0 mm.

8. The blade set as claimed in claim 1, wherein the lateral protecting element overlaps the stationary blade in the longitudinal direction (X) at the cutting edge, and wherein the lateral protecting element comprises a smoothed longitudinal end transition, further wherein the smoothed longitudinal end transition comprises a frontal end rounding that is arranged to contact the skin, when in use for shaving purposes.

9. The blade set as claimed in claim 1, wherein the recessed portion in the lateral protecting element further comprises the aperture being surrounded by three respective walls of the lateral protecting element.

10. The blade set as claimed in claim 1, wherein the at least steel of the stationary blade and the movable blade comprises sheet metal material, and wherein the plastic material of the lateral protecting element comprises a thermoplastic material.

11. The blade set as claimed in claim 1, wherein the lateral protecting element is form-fitted to the stationary blade via a positive-locking feature.

12. The blade set as claimed in claim 1, wherein the lateral protecting element is molded to the stationary blade, further wherein the lateral protecting element is overmolded to or insert-molded with the stationary blade.

13. The blade set as claimed in claim 1, wherein the at least one toothed cutting edge of the stationary blade comprises (i) the first toothed cutting edge having the first plurality of teeth and (ii) a second toothed cutting edge, longitudinally spaced and on an opposite side of the stationary blade a distance from the first toothed cutting edge, having a second plurality of teeth, wherein the toothed cutting edge of the movable blade comprises (i) a first toothed cutting edge having a first plurality of teeth arranged to cooperate with the first plurality of teeth of the stationary blade in a cutting action for cutting hair in a first moving direction of the blade set and (ii) a second toothed cutting edge, longitudinally spaced and on an opposite side of the movable blade from the first toothed cutting edge of the movable blade, having a second plurality of teeth arranged to cooperate with the second plurality of teeth of the stationary blade in another cutting action for cutting hair in a second moving direction, opposite the first moving direction, of the blade set, and wherein the lateral protecting element comprises a longitudinal extension that (i) overlaps or tops both the first tooth cutting edge and the second toothed cutting edge of the stationary blade, and (ii) serves as a sliding skid into opposite first and second moving directions, respectively, to cut hair for trimming operations, wherein the longitudinal extension is formed by the lateral protecting element having a width dimension that is wider than the distance between the first toothed cutting edge and the second toothed cutting edge of the stationary blade.

14. A hair cutting appliance comprising a housing accommodating a motor, a drive mechanism, and a cutting unit coupled to the motor via the drive mechanism, wherein the cutting unit comprises a blade set as claimed in claim 1.

15. The hair cutting appliance as claimed in claim 14, wherein the blade set is pivotably mounted to the housing in an exposed manner in which the blade set is spaced from and independent of the housing except where the blade set is pivotably mounted to the housing and coupled to the motor via the drive mechanism.

16. The hair cutting appliance as claimed in claim 15, wherein the lateral protecting element is adapted to pivot along with the blade set in which both the lateral protecting element and the blade set undergo similar motion and orientation changes when in use.

17. The hair cutting appliance as claimed in claim 14, wherein the lateral end of the stationary blade is independent of the housing, neither being embedded in nor shielded by the housing.

18. The hair cutting appliance as claimed in claim 14, wherein the blade set comprises a contour-following blade set configured to pivot or swivel with respect to the housing.

19. The hair cutting appliance as claimed in claim 14, wherein the lateral protecting element is exposed at the top end surface, the bottom end surface, and the recessed portion, the lateral protecting element being spaced from and independent of the housing, neither being embedded in nor shielded by the housing.

* * * * *